US010274147B2

(12) United States Patent
Chou

(10) Patent No.: US 10,274,147 B2
(45) Date of Patent: Apr. 30, 2019

(54) DOUBLE-AXIS ROTATING LAMP JOINT

(71) Applicant: Tachiun Chou, Brooklyn, NY (US)

(72) Inventor: Tachiun Chou, Brooklyn, NY (US)

( * ) Notice: Subject to any disclaimer, the term of this patent is extended or adjusted under 35 U.S.C. 154(b) by 177 days.

(21) Appl. No.: 15/399,170

(22) Filed: Jan. 5, 2017

(65) Prior Publication Data

US 2018/0187872 A1 Jul. 5, 2018

(51) Int. Cl.

| | |
|---|---|
| ***F21S 6/00*** | (2006.01) |
| ***F21V 3/02*** | (2006.01) |
| ***F21V 21/30*** | (2006.01) |
| ***F21V 23/00*** | (2015.01) |
| ***F21V 23/04*** | (2006.01) |
| ***F21W 121/00*** | (2006.01) |
| ***F21Y 115/10*** | (2016.01) |

(52) U.S. Cl.

CPC ..... *F21S 6/006* (2013.01); *F21S 6/003* (2013.01); *F21V 3/02* (2013.01); *F21V 21/30* (2013.01); *F21V 23/002* (2013.01); *F21V 23/0485* (2013.01); *F21W 2121/00* (2013.01); *F21Y 2115/10* (2016.08)

(58) Field of Classification Search

CPC ..... F21V 21/28; F21V 7/0091; F21V 21/108; F21V 23/002; F21S 6/003; F21S 6/006

USPC ..... 362/235

See application file for complete search history.

(56) References Cited

U.S. PATENT DOCUMENTS

| | | | | |
|---|---|---|---|---|
| 4,146,919 | A * | 3/1979 | Jennings | F21V 33/0056 362/147 |
| 4,214,296 | A * | 7/1980 | Magett | F21S 10/06 362/147 |
| 6,761,540 | B2 * | 7/2004 | Tseng | F04D 29/601 248/342 |
| 7,104,513 | B2 * | 9/2006 | Blateri | F04D 25/088 248/342 |
| 2006/0120092 | A1 * | 6/2006 | Sapper | F21S 6/003 362/427 |
| 2007/0014099 | A1 * | 1/2007 | Lin | A63B 43/06 362/35 |
| 2007/0248353 | A1 * | 10/2007 | Chen | G03B 17/00 396/428 |
| 2010/0277089 | A1 * | 11/2010 | Chien | H04N 5/2354 315/287 |
| 2014/0022777 | A1 * | 1/2014 | Chen | F21V 19/02 362/220 |
| 2017/0307151 | A1 * | 10/2017 | Deng | F21S 6/003 |
| 2017/0307196 | A1 * | 10/2017 | Matsui | F21V 29/763 |

* cited by examiner

*Primary Examiner* — Bryon T Gyllstrom

(74) *Attorney, Agent, or Firm* — Keala Chan; Chan Hubbard PLLC

(57) ABSTRACT

A double-axis rotation joint for use in a lamp or lighting system. The lamp joint rotates in a first axis and is in continuous interior connection with two wire guides that rotate in a second axis perpendicular to the first axis. The two wire guides are connectors that can be attached to a light guide that receives an illumination source. The light guide accommodates rotation in the second axis without colliding with the first axis. The end result is a double-rotation system in two dimensions that supports a fully positionable, task-illuminating lamp or lighting system. Using a spherical cover, the lighting system appears as a rotating orb.

9 Claims, 8 Drawing Sheets

DOUBLE-AXIS ROTATING LAMP JOINT

FIELD OF THE INVENTION

This present invention relates to furniture and décor, particularly to lighting design.

DESCRIPTION OF THE RELATED ART

The present invention relates to electric light sources, such as fluorescent, incandescent and LED torches, wall sconces, and lamps. Light sources may be used for indoor and outdoor décor, as well as theater and set design, to provide general and diffuse lighting, but may also be functional, as in the case of work lamps providing task-specific illumination. Work lamps often have pivotable arms and joints to allow for flexible positioning. Lamps with flexible positioning must accommodate electrical wires that will hold up under extensive rotation and movement. Wires may be exposed to prevent entanglements. In addition, work lamps may be associated with an industrial aesthetic, and therefore may not meet specific requirements with regards to size and décor.

BRIEF SUMMARY OF THE INVENTION

Disclosed herein is a lamp joint that is rotatable along two perpendicular axes for flexible positioning. The lamp joint conceals wires, enables a lamp to provide task-specific illumination, can be incorporated into a variety of stands and attachments, and furthermore elegantly merges form and function for an aesthetically pleasing effect.

The double-axis rotation system is comprised of a rotating head joint in a first axis, wherein the head joint has two rotating guides in a second axis perpendicular to the first axis. These rotating guides and head joint accommodate electrical wiring to a light guide in the second axis. The light guide receives a source of illumination, such as fluorescent, incandescent or LED light. Thus, this light can be rotated in both the first axis and the second axis, making it fully positionable to provide task-specific illumination.

The rotating lamp joint can be incorporated into many lamps and lighting systems, including tabletop lamps, standing lamps, and wall sconces, to name a few. Furthermore, a lamp using the joint can be coupled to a pivotable arm, such that it becomes rotational in three dimensions. In the preferred embodiment of a lamp using the joint, the light is contained in a spherical shade or cover. The cover is translucent and a built-in corridor accommodates rotation in the second axis without distorting the effect of the sphere. Thus, the lamp embodies a glowing, rotating orb, like a planet or a sun.

BRIEF DESCRIPTION OF THE DRAWINGS

In the following drawings, like reference numbers have been used wherever possible to indicate like parts in different views.

DETAILED DESCRIPTION OF THE INVENTION

Figure 2:
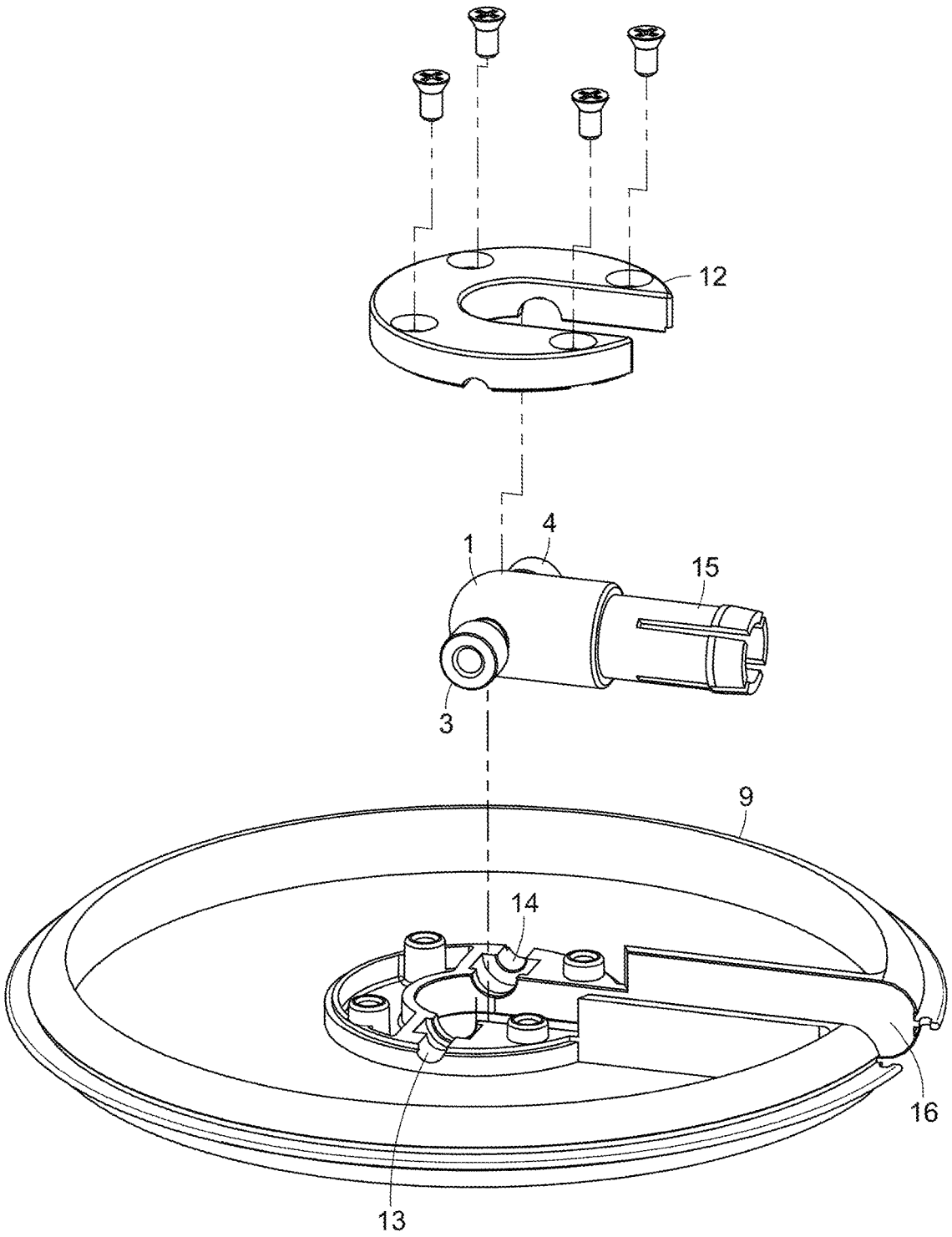
FIG. 2 is an exploded view of an exemplary attachment system for the rotating head joint.
Figure 3:
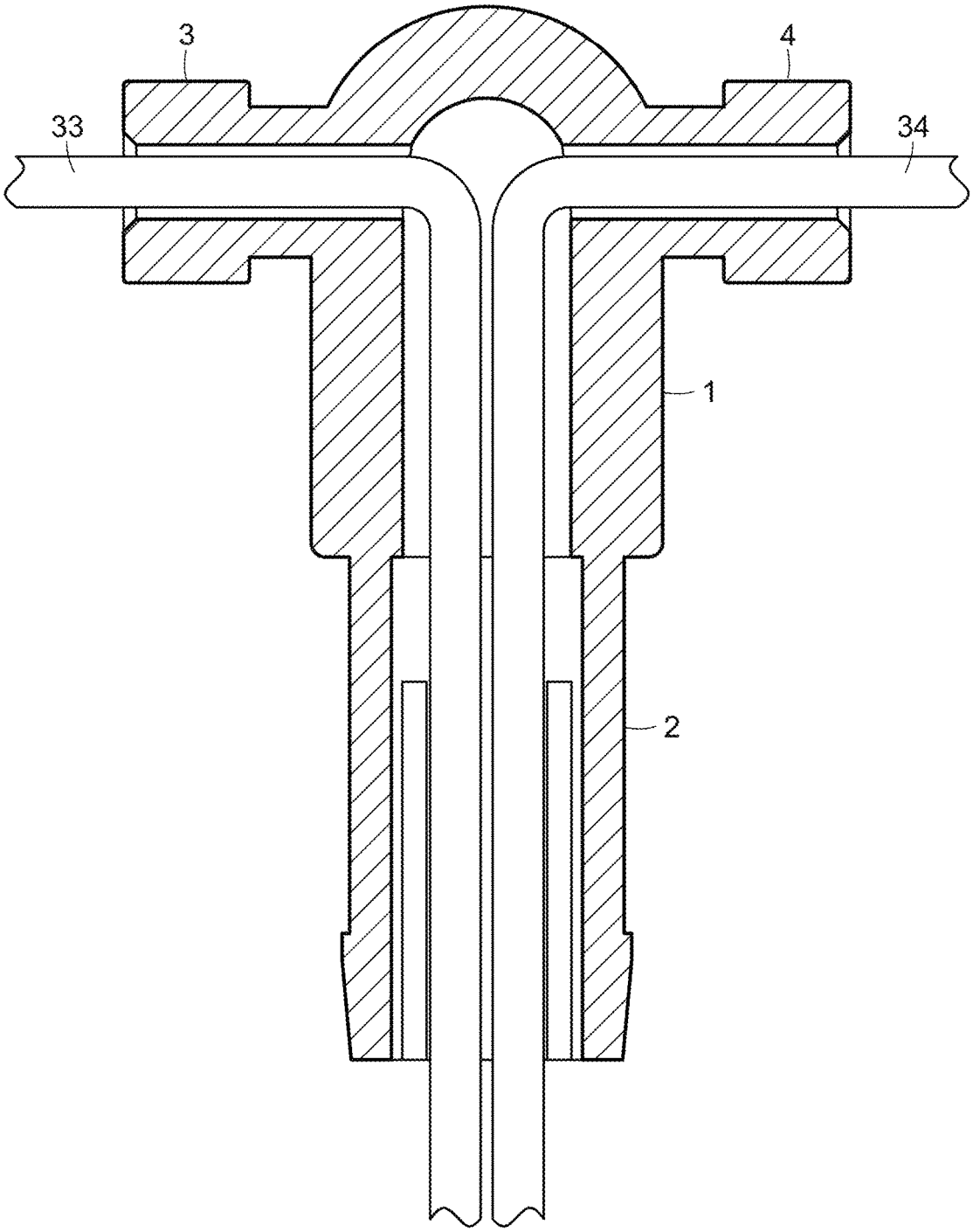
FIG. 3 is a cross-sectional view of the lamp joint.

This versatile lamp joint presents a novel solution for rotation in a first and a second axis as follows: A head joint 1 is rotatable around an arm 2 in a first axis. The head joint is coupled to wire guides 3 and 4 that lie in a second axis perpendicular to the first axis. Guides 3 and 4 are themselves rotatable around the second axis. These guides 3 and 4 are connectors that can be coupled to light guide 10 such that a light 5 can be positioned and directed as the user desires. The light guide 10 can receive any type of illumination source, including but not limited to fluorescent, incandescent and light emitting diode (LED). In the case of LED, the light guide can receive an electronic circuit board with one or more LED. The arm 2, rotating joint 1 and rotating guides 3 and 4 are in continuous interior connection to accommodate one or more electric wires 33 and 34 supplying electricity to the light (see FIG. 3). In particular, each wire guide 3 and 4 receives at least one electric wire. In the preferred embodiment, head joint 1 is coupled to a connector 15, so that the lamp joint can be used in any type of lamp. Connector 15 is depicted as a snap-in connector in FIG. 2, but can be any type of connector known in the art, such as threaded or magnetic.

The lamp using the head joint can be rotated 360° in the first axis. Depending on the structure of the light guide, the lamp can be rotated up to 360° in the second axis. The embodiment depicted herein contemplates a planar light guide 10 but the light guide can be any shape or size without deviating from the spirit of the invention. In the case of a planar light guide 10, the guide must be shaped to accommodate the arm 2 to allow the guide to rotate in the second axis. Thus, as depicted herein, rotation in the second axis is made possible by a linear slot 6 in the light guide, accommodating arm 2 and allowing rotation of up to 180° in the second axis. In other embodiments, the light guide may be constructed to accommodate the arm 2 in up to 360° rotation.

Wire guides 3 and 4 may be coupled to light guide 10 by any construction preferred by one of ordinary skill in the art. In the preferred embodiment, the light guide 10 comprises indents 13 and 14 for receiving the wire guides, and furthermore receives retainer bracket 12 to hold the guides in place, such that rotation of the wire guides results in rotation of the light guide. Preferably the light guide 10 also comprises a heat sink to reduce heat wear and damage on the parts.

Figure 1:
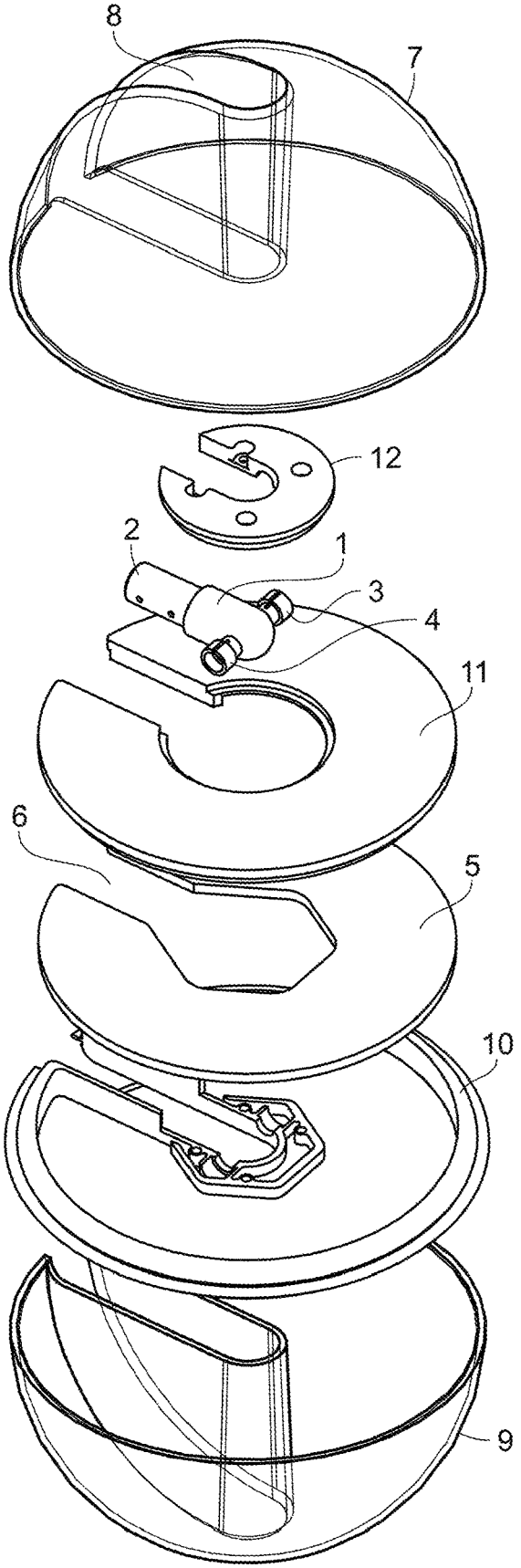
FIG. 1 is an exploded view of the lamp joint with spherical cover.

In a preferred lighting system using the lamp joint, light guide 10 is substantially disc-shaped with a linear slot 16 to accommodate the guide arm 2 for rotation. A light 5 comprised of electronic circuit board with LED fits into the light guide and optionally the light may be diffused using diffuser 11. While the embodiment depicted shows a one-sided light guide and single light, any variation on light shape, illumination direction, and light placement are possible. The preferred lighting system utilizes a spherical cover 21 (also shown as two hemispheres 7 and 9 in FIG. 1) coupled to the light guide and comprising a corridor 8 such that rotation of the light guide results in rotation of the spherical cover in the second axis. For aesthetic reasons, the corridor 8 of the preferred embodiment is located in one hemisphere, allowing the sphere to rotate up to 180° in the second axis. Without departing from the spirit of the invention, the corridor may extend further to allow rotation greater than 180°.

The spherical cover has the added benefit of concealing wires and hardware, increases the diffusion of the light, and lends balance and symmetry to the double-axis rotation system. While the preferred embodiment comprises a circular disc light 5 with spherical cover 21, the double-axis rotation system does not necessarily require either shape, so long as interior parts and exterior cover are shaped to accommodate arm 2 during rotation in the second axis.

Figure 4:
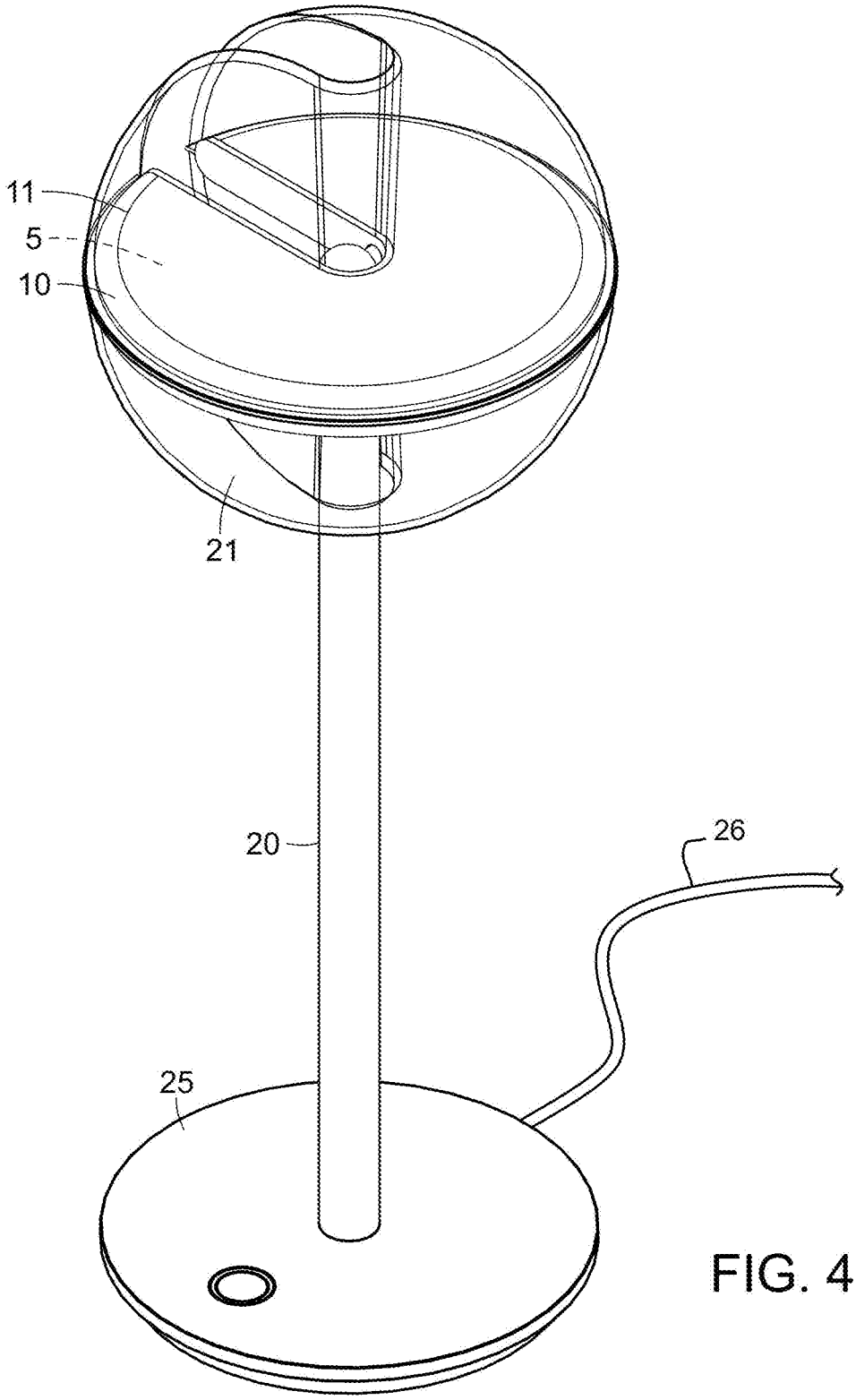
FIG. 4 is a perspective view of a tabletop embodiment of a lamp using the joint.
Figure 5A:
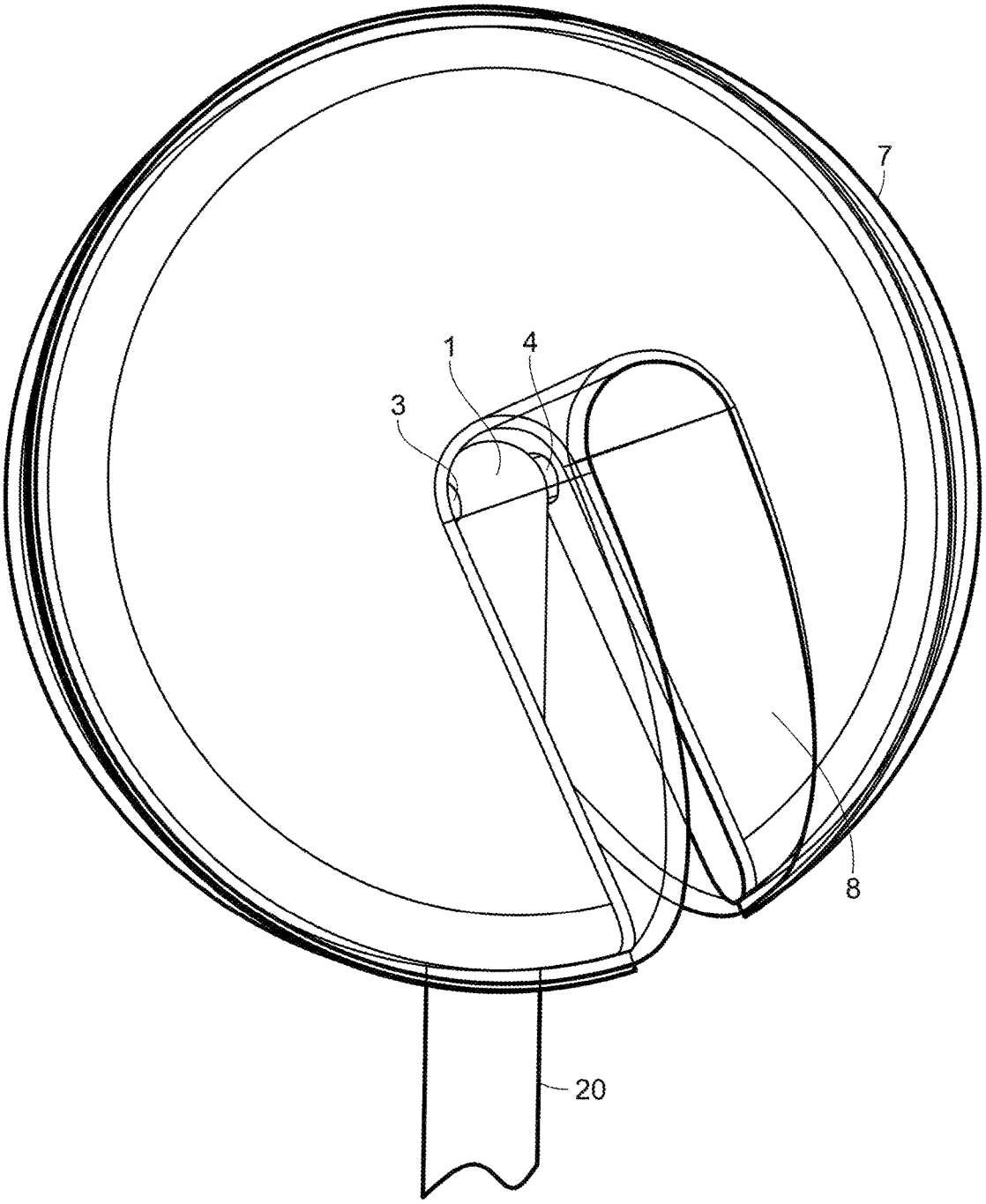
FIG. 5*a* is a close-up perspective view of the lamp in partial rotation around the second axis of the joint.
Figure 5B:
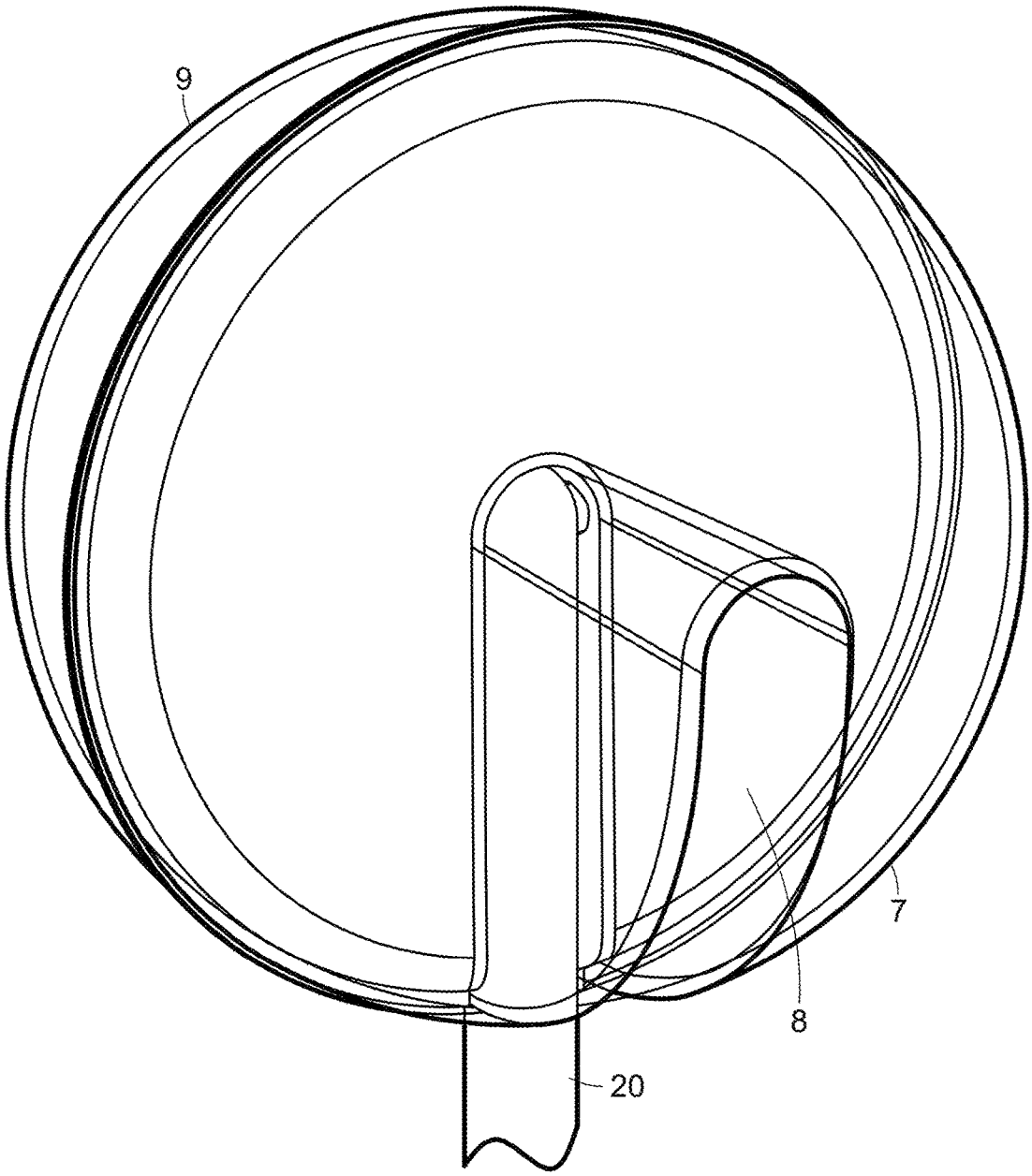
FIG. 5*b* is a close-up perspective view of the lamp in 0° rotation around the second axis.

The double-axis rotation system can be applied to many lighting systems. In a tabletop embodiment shown in FIG. 4, arm 20 is supported by base 25. Electricity is supplied via wire 26 threaded through the base and arm to the light. FIG. 5*b* shows the lamp in 0° rotation around the second axis, while rotation around the first axis can occur in 360° via rotating head joint 1. FIG. 5*a* shows the lamp in a 45° rotation around the second axis, via rotating guides 3 and 4. Naturally, this tabletop embodiment can be made into a standing system simply by extending the length of the arm.

Figure 6:
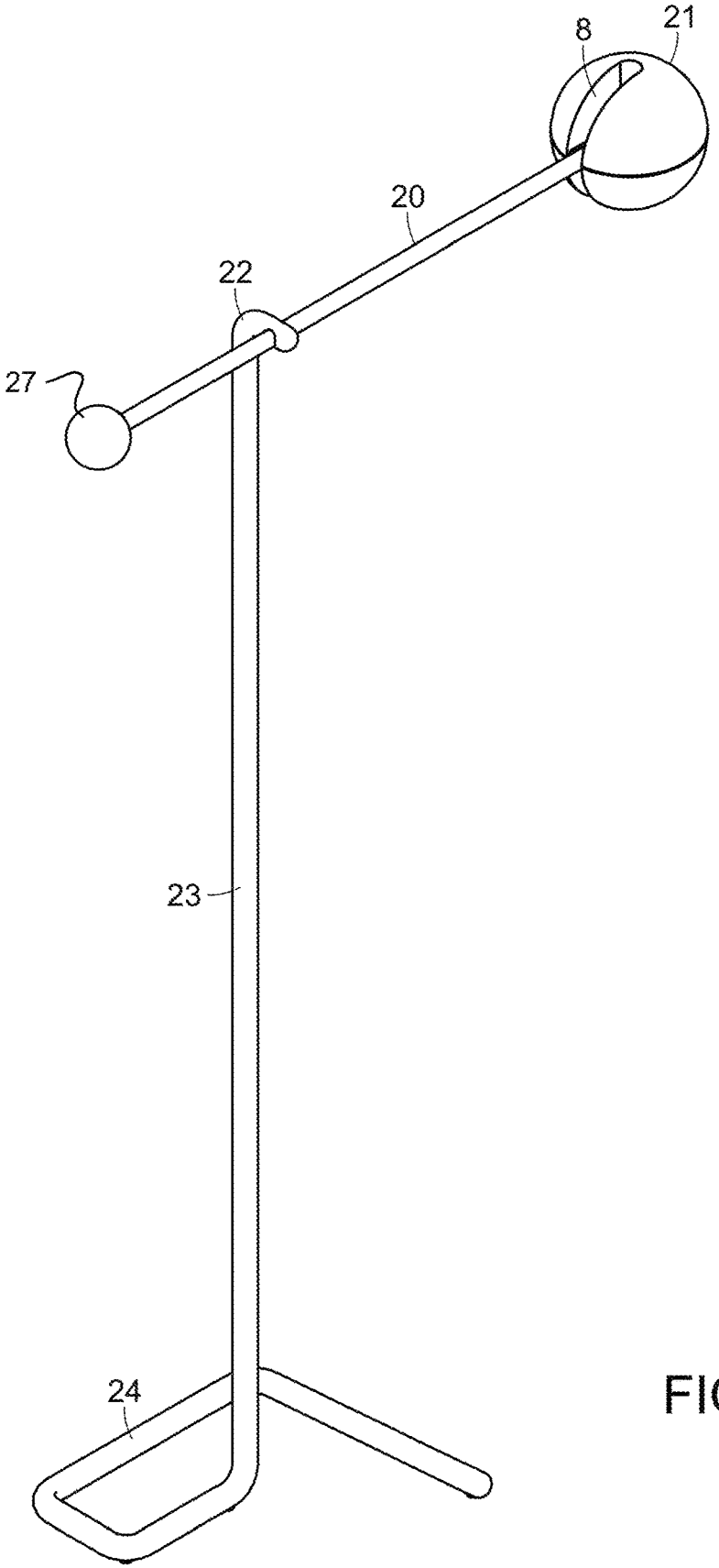
FIG. 6 is a perspective view of a standing embodiment of the lamp using the joint.

In another embodiment, depicted in FIG. 6, arm 20 is a cantilever coupled to a second rotating joint 22. The second rotating joint 22 is attached to and rotatable around leg 23, which is supported by base 24. Naturally, this second embodiment can also be made in a tabletop version simply by shortening the length of the leg. This second embodiment increases the versatility and positionability of the lamp by enabling rotation in a third dimension.

Figure 7:
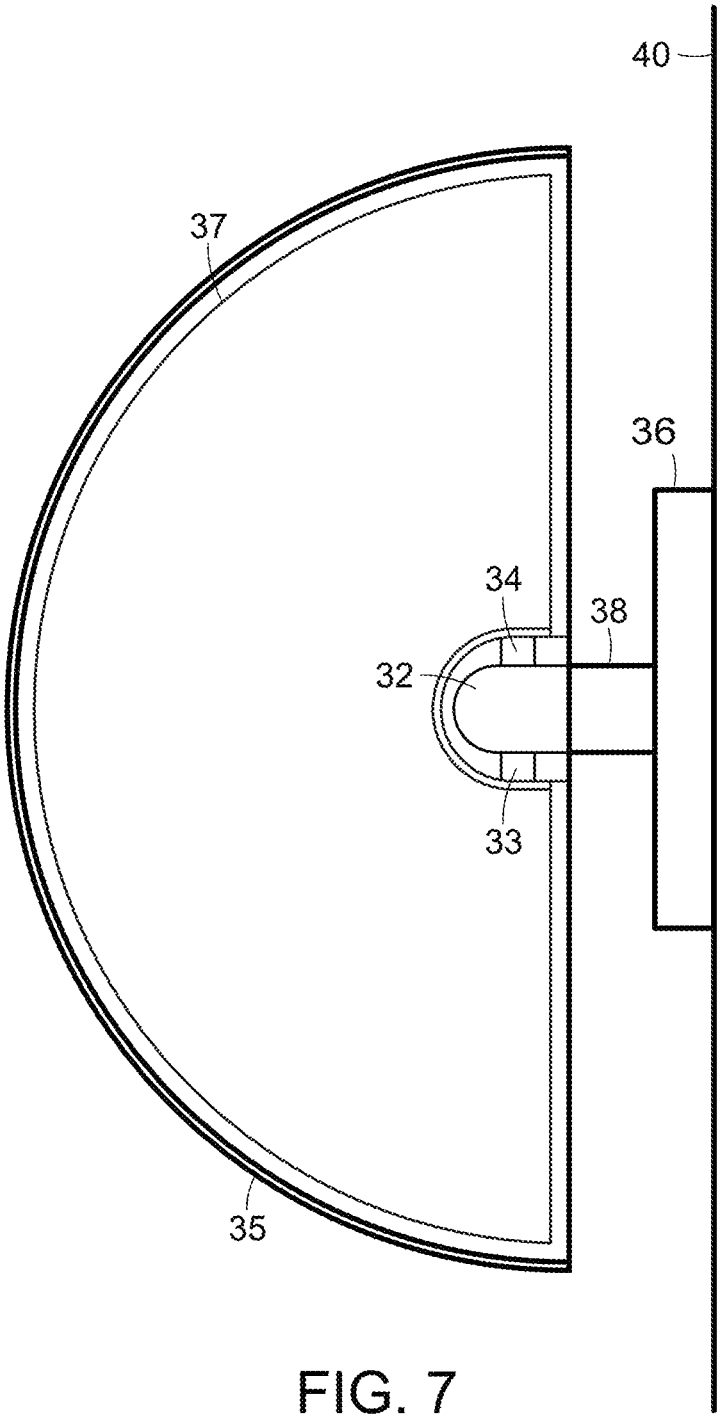
FIG. 7 is a side cross-section view of a wall sconce embodiment of the lamp using the joint.

In a wall sconce embodiment, depicted in FIG. 7, arm 38 is a cantilever coupled to a base 36 for attachment to a surface such as a wall 40 or ceiling. In this embodiment, rotation in the second axis may be limited depending on the shape of the lamp and its distance from the surface to which it is affixed. For instance, in the preferred sconce embodiment, the lamp comprises a hemispherical cover 37 that would limit the rotation in the second axis.

As another example, it is contemplated that the lamp can be integrated into a chandelier system comprising multiple lamps. The aforementioned embodiments are intended to be exemplary and not limiting. The lamp can be integrated into practically any lighting system.

The lamp can be powered by any means, including but not limited to disposable and rechargeable battery and AC or DC current. In keeping with the simple design of the lamp, the lamp is preferably activated by touch sensor. For instance, in the tabletop version, the lamp can be activated by touch at base 25. Furthermore the capacitive touch sensor can incorporate dimming technology to adjust the brightness of the light by touch. In the embodiment utilizing a second rotating joint 22 for rotation in a third dimension, it is contemplated that a balancing sphere 27 serves as the touch sensor location. The use of a balancing sphere 27 harmonizes the design of the lamp, but the light activating touch sensor can reasonably be located anywhere on the lamp.

Finally, it is currently known to incorporate power supply design and architecture into the features and functions of a lighting system, including, but not limited to, one or more USB ports for charging of cell phones and other devices. Similarly, the incorporation of other electronic elements such as clocks, speakers, wireless transmitters, etc. . . . would all be feasible additions to the functionality of the system.

The invention claimed is:

1. A lighting system comprising:

a. a head joint rotatable in a first axis, the head joint comprising two wire guides rotatable in a second axis perpendicular to the first axis, and the head joint and the two wire guides having continuous interior connection for receiving one or more wires;

b. a planar light guide surrounding the head joint and supporting one or more LEDs powered by the one or more wires, wherein the planar light guide is coupled to the two wire guides such that the planar light guide is rotatable in the second axis along with the two wire guides; and c. an arm in the first axis and coupled to the head joint at the end of the arm, such that the head joint is rotatable around the arm, the arm having continuous interior connection with the head joint and the two wire guides for receiving the one or more wires;

wherein the planar light guide comprises a slot from the center of the planar light guide to an edge of the planar light guide in order to accommodate the arm, such that the arm travels through said slot when the planar light guide rotates in the second axis.

2. The lighting system of claim 1 wherein the planar light guide receives an electronic circuit board having one or more light emitting diodes.

3. The lighting system of claim 1 wherein the planar light guide is a disc and further comprising a spherical cover enclosing the disc at the great circle of the sphere and comprising a corridor located in one hemisphere and aligned with the slot of the disc allowing the cover to rotate in the second axis.

4. The lighting system of claim 1 wherein the arm is coupled to a second joint rotatable in a third axis, the second joint is coupled to a leg in the third axis, and the leg is coupled to a base supporting the leg.

5. The lighting system of claim 3 wherein the arm is coupled to a second joint rotatable in a third axis, the second joint is coupled to a leg in the third axis, and the leg is coupled to a base supporting the leg.

6. The lighting system of claim 1 wherein the arm is coupled to a base attachable to a surface, and further comprising a cover coupled to the planar light guide, the cover being substantially hemispherical.

7. A lamp joint comprising:

a. a first connector in a first axis;

b. a head joint covering the end of the first connector, rotatable around the first connector, and in interior connection with the first connector to receive at least two wires; and c. a left-side connector and right-side connector located on opposite sides of the head joint, wherein the left-side and right side connectors are aligned in a second axis perpendicular to the first axis and rotatable in the second axis, and each of the left-side and right-side connectors receives one of the at least two wires.

8. The lamp joint of claim 7 wherein the left-side and right-side connectors are coupled to a light guide such that rotation of the pair of connectors causes rotation of the light guide in the second axis.

9. The lamp joint of claim 8 wherein the light guide comprises a gap to accommodate the first connector when the light guide is rotated in the second axis.

* * * * *